United States Patent [19]

Ikehara et al.

[11] Patent Number: 4,560,406

[45] Date of Patent: Dec. 24, 1985

[54] PROCESS FOR REFINING OF CHROMIUM-CONTAINING MOLTEN STEEL

[75] Inventors: Yasunobu Ikehara; Haruki Ariyoshi; Ryoichi Hidaka, all of Hikarishi, Japan

[73] Assignee: Nippon Steel Corporation, Tokyo, Japan

[21] Appl. No.: 653,784

[22] Filed: Sep. 24, 1984

[30] Foreign Application Priority Data

Dec. 2, 1983 [JP] Japan ..... 58-227887

[51] Int. Cl.[4] ..... C21C 7/02

[52] U.S. Cl. ..... 75/30; 75/53; 75/58

[58] Field of Search ..... 75/30, 53, 58

[56] References Cited

U.S. PATENT DOCUMENTS 2,980,529 4/1961 Knapp ..... 75/57

3,702,243 11/1972 Miltenberger ..... 75/57

4,374,664 2/1983 Mitsuo ..... 75/58

*Primary Examiner*—Peter D. Rosenberg

*Attorney, Agent, or Firm*—Wenderoth, Lind & Ponack

[57] ABSTRACT

The refining of chromium-containing molten steel by the treatments of decarburization, reduction, and desulfurization is improved in terms of consumption of argon gas used for blowing molten steel, amount of refractories of an AOD furnace, and CaO and $CaF_2$, etc. by a process which comprises adding to the slag existing after completion of the decarburization, metallic Al as a reducing agent and CaO as a slag-forming agent respectively in amounts necessary for the slag, after completion of the subsequent reduction, to acquire a $SiO_2$ content of not more than 10% and a $CaO/Al_2O_3$ ratio in the range of 0.8 to 2.0, thereby enabling the treatments of reduction and desulfurization to proceed simultaneously.

6 Claims, 6 Drawing Figures

PROCESS FOR REFINING OF CHROMIUM-CONTAINING MOLTEN STEEL

BACKGROUND OF THE INVENTION

1. Field of the Invention

This invention relates to a process for the refining of chromium-containing molten steel wherein the recovery of Cr from chromium oxide in the slag, namely the reduction of the slag, and the removal of S from the molten steel, namely the desulfurization of the molten steel, are effected simultaneously and efficiently.

2. Description of the Prior Art

The conventional process for the refining of chromium-containing molten steel is divided, as illustrated in FIG. 1(*a*), into a step of decarburization, a step of reduction, and a step of desulfurization. During the decarburization, the molten steel is blown with $O_2$ to strip C from the molten steel in the form of CO or $CO_2$. At this time, part of Cr in the steel is released in the form of Cr oxide into the slag. The Cr oxide, therefore, is reduced by addition of Fe—Si as a reducing agent and CaO and $CaF_2$ as slag-forming agents. The slag which has undergone this reduction, however, has a high melting point. For this and other reasons, it has no sufficient desulfurizing ability. It is customary for the conventional process to include the step of desulfurization wherein the slag just mentioned is discarded and new slag for desulfurization is prepared. This step entails drawbacks such as extension of the refining period, increase of the consumption of argon gas for refining, increase of the amount of refractories lost, and increase of the amount of flux for refining.

The CaO—$SiO_2$ type slag has been adopted to date for the reduction and desulfurization of chromium-containing molten steel. In the operation, it has been customary for the basicity $CaO/SiO_2$ to be selected in the range of 1.4 to 1.8 where the efficiency of reduction preponderates, or above 2.0 where the efficiency of desulfurization is more significant. This slag, however, has a very high melting point as noted from FIG. 2. Where the basicity $CaO/SiO_2$ falls in the range of 1.4 to 1.8, the melting point of the slag reaches such a high level as 1700° to 1900° C. Actually, the slag additionally contains such components as MgO, $Al_2O_3$, and $TiO_2$ (whose total content barely falls in the range of 10 to 15%), which lower the slag's melting point. The lowered melting point of the slag still falls in the range of 1600° to 1700° C., a level which is high as compared with the level of 1580° to 1650° C. necessary for reduction and desulfurization of ordinary chromium-containing molten steel. For promoting the formation of slag, therefore, the elevation of the temperature of the molten steel or the addition of a large amount of $CaF_2$ has been an inevitable recourse. These measures, however, notably aggravate loss of refractories of the refining furnace. Any attempt to curb the loss of refractories automatically results in retardation of reduction and desulfurization and in degradation of their efficiencies.

Japanese Patent Application Laid-open SHO 58(1983)-22318 discloses a method for reducing the time required for the refining of chromium-containing molten steel, which comprises adding to the slag, before completion of the decarburization, part or all of the amount of CaO required as a flux for desulfurization, and adding thereto, after completion of the decarburization, the remainder of CaO, if any, and the amount of Fe—Si required for reduction, thereby effecting the desulfurization simultaneously with the reduction. It can hardly be said, however, that this method gives a perfect solution to the aforementioned problems due to the use of the CaO—$SiO_2$ type slag.

An object of this invention is to provide a process for the refining of chromium-containing molten steel which completely eliminates the aforementioned problems encountered by the conventional process of refining and, therefore, permits notable reduction of time required for the refining, improvement of the service life of the furnace, great saving of the consumption of slag-forming agent and refining gas, conspicuous improvement of the efficiency of desulfurization, and fair economization of energy.

SUMMARY OF THE INVENTION

The object of this invention described above is accomplished in the refining of chromium-containing molten steel through the treatments of decarburization, reduction, and desulfurization, by adding to the slag existing after completion of the decarburization, metallic Al as a reducing agent and CaO as a slag-forming agent respectively in amounts necessary for the slag, after completion of the subsequent reduction, to acquire a $SiO_2$ content of not more than 10% and a $CaO/Al_2O_3$ ratio in the range of 0.8 to 2.0, thereby enabling the treatments of reduction and desulfurization to proceed simultaneously.

Other objects and advantages of the present invention will become apparent from the disclosure of the invention given in the following detailed description of preferred embodiments, with reference to the accompanying drawings.

BRIEF DESCRIPTION OF THE DRAWINGS

FIG. 1(*b*), FIG. 1(*c*), FIG. 1(*e*), and FIG. 1(*f*) are diagrams illustrating various modes of effecting the steps of refining performed on chromium-containing molten steel in accordance with the present invention.

FIG. 3(*b*) is a diagram showing the change of S in the chromium-containing molten steel through the steps of refining performed on the molten steel in accordance with this invention. FIG. 3(*c*) is a diagram showing the change of S in the chromium-containing molten steel through the steps of refining performed on the molten steel in accordance with this invention, wherein Al and CaO are added in the terminal phase of the step of decarburization.

DETAILED DESCRIPTION OF THE INVENTION

Figure 2:
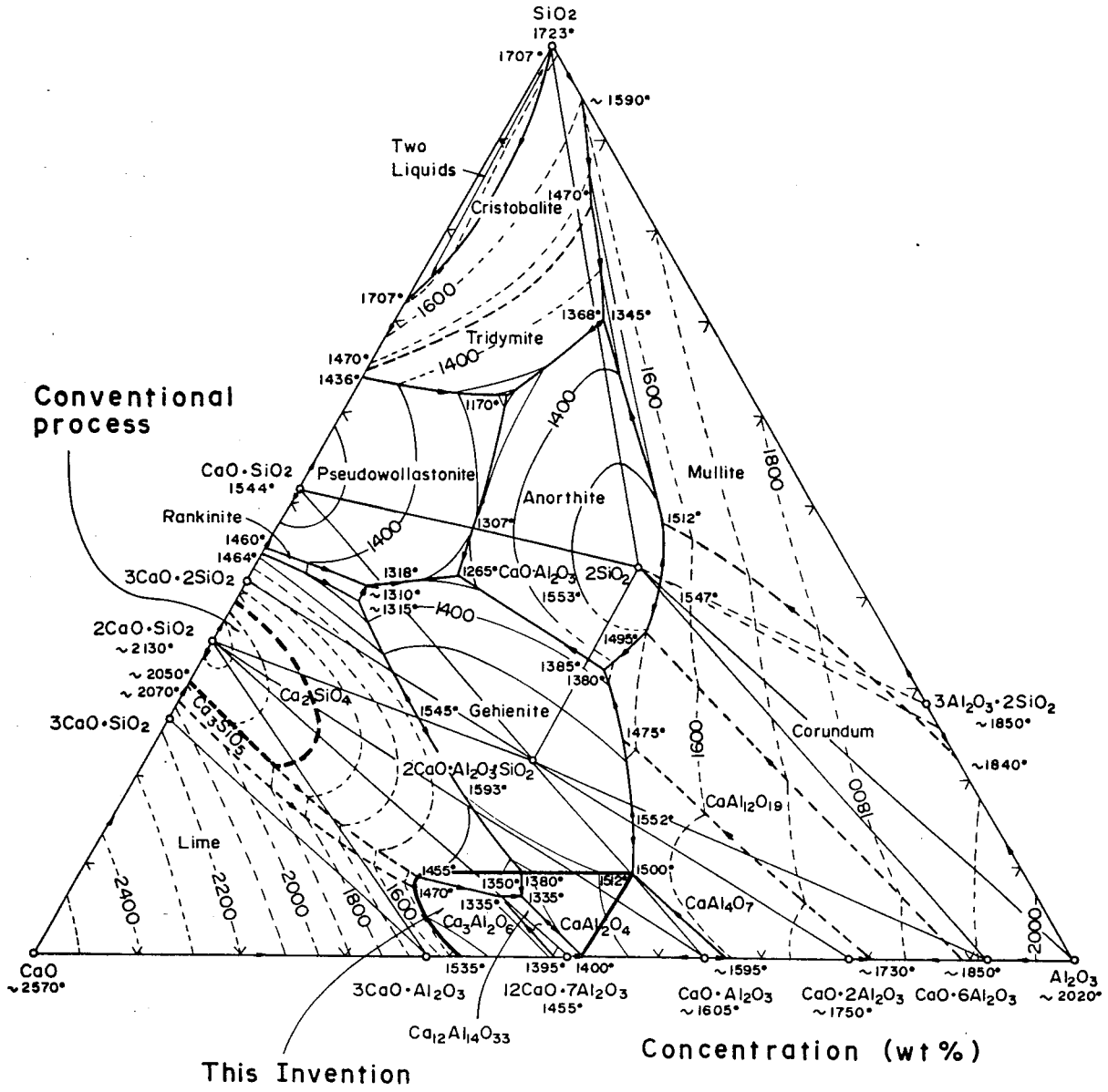
FIG. 2 is a ternary phase diagram of the CaO—$Al_2O_3$—$SiO_2$ system.

This invention, in the refining of chromium-containing molten steel by the steps of decarburization, reduction, and desulfurization, is directed to enabling the steps of reduction and desulfurization to proceed simultaneously by making use of a $CaO—Al_2O_3$ type slag after completion of the step of decarburization. It has been customary for the conventional process to add Si as a reducing agent to the slag existing after completion of the decarburization. The process of this invention is characterized by adding Al in place of Si as a reducing agent and CaO as a slag-forming agent to the slag mentioned above, thereby allowing not only reduction of chromium oxide but also reduction of $SiO_2$ to be thoroughly effected simultaneously with desulfurization of the molten steel. To be specific, the amounts of CaO and Al to be added during the step of reduction are adjusted so that the slag, after completion of the treatment of reduction, acquires a composition wherein the $CaO/Al_2O_3$ ratio is in the range of 0.8 to 2.0 and the $SiO_2$ content is not more than 10%. As the result, the melting point of the slag can be lowered to a level of 1350° to 1500° C. as noted from FIG. 2. Thus, the slag is allowed to retain its fluidity amply at 1580° to 1650° C., the level of temperatures necessary for reduction and desulfurization of chromium-containing molten steel as already described. Thus, the process of this invention has no use for $CaF_2$ as a slag-forming agent and enjoys notably improved efficiencies of reduction and desulfurization.

Now, the present invention will be described below with reference to the AOD process, which is the most popular of all the processes available for the production of stainless steel.

The term "AOD process", an acronym for Argon Oxygen Decarburization, comprises diluting the CO gas issuing from decarburization with argon gas, thereby lowering the CO partial pressure, maximally curbing the oxidation of Cr in the molten steel bath, and ensuring efficient decarburization. In the region of high C content in the molten steel bath, the decarburization is carried out with the oxygen/argon ratio adjusted on the oxygen-rich side. As the C content in the bath falls, the decarburization is continued, with the ratio adjusted on the argon-rich side.

Figure 1:
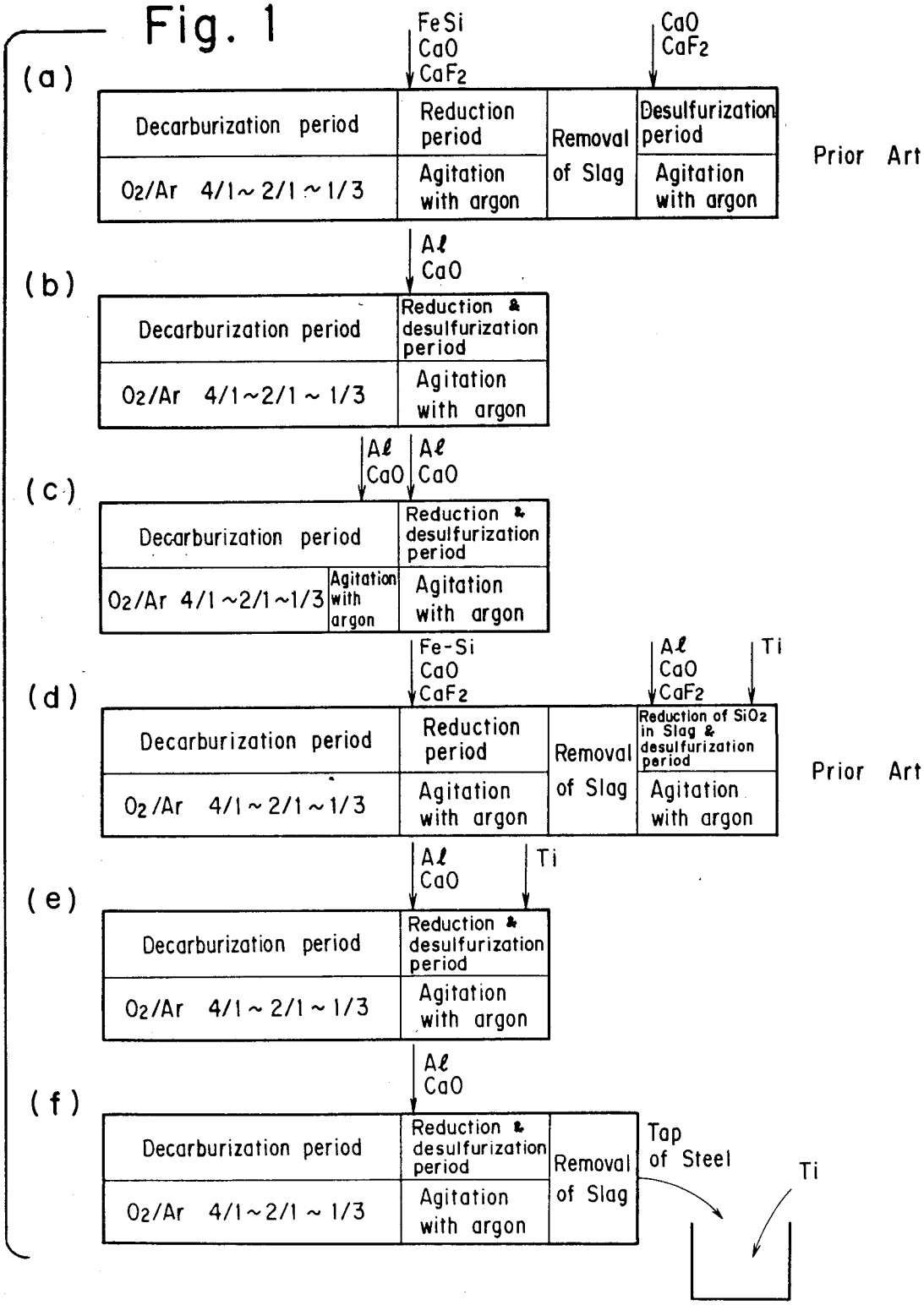
FIG. 1(*a*) and FIG. 1(*d*) are diagrams illustrating the steps of decarburization, reduction, and desulfurization performed on chromium-containing molten steel by the AOD process.

FIG. 1(*a*) illustrates the steps of decarburization, reduction, and desulfurization performed on chromium-containing molten steel by the conventional AOD process. Generally after completion of the decarburization, Fe—Si for reduction and CaO and $CaF_2$ as slag-forming agents are added to the slag so as to control the slag's basicity $CaO/SiO_2$ in the range of 1.4 to 1.8, and argon gas alone is blown in for agitation of the steel bath to initiate the reduction of chromium oxide. During the course of this reduction, desulfurization is also carried out. However, since the melting point of the slag is high as already described, the formation of slag doesn't occur amply and the fluidity of the slag is insufficient. For the purpose of achieving sufficiently high basicity ($CaO/SiO_2$), it has been customary for the existent slag to be discarded and replaced with fresh slag prepared for desulfurization.

In contrast, the present invention contemplates adding Al for reduction in the place of Si, and CaO as a slag-forming agent, and effecting agitation of the molten steel bath by argon gas after completion of the decarburization as illustrated in FIG. 1(*b*). As regards the amount of Al so added, since the amount of oxygen spent in the oxidation of metals (Cr, Si, Mn, Fe, etc.) present in the molten steel is known from the efficiency of decarburization during the course of decarburization, the amount of Al necessary for the reduction of the oxygen can be easily found by calculation. With respect to the amount of oxygen in the slag which is entrained by the molten steel during the introduction of the molten steel into the AOD furnace, the amount of Al to be added can be determined by calculating the amount of oxygen to be reduced by Al based on the composition and weight of the slag.

Then, the slag of a low melting point described above can be produced by determining the amount of CaO relative to the amount of Al found as above so that the $CaO/Al_2O_3$ ratio will fall in the range of 0.8 to 2.0.

Operation and Effect:

Now, the reduction reaction which is brought about where Al and Si have been added will be considered.

| | Calorific value | |
|---|---|---|
| In the case of Al reduction | | |
| $Cr_2O_3 + 2Al \longrightarrow Al_2O_3 + 2Cr$ | 129,800 Kcal/mol | (1) |
| $SiO_2 + \frac{4}{3}Al \longrightarrow \frac{2}{3}Al_2O_3 + Si$ | 54,400 | (2) |
| $MnO + \frac{2}{3}Al \longrightarrow \frac{1}{3}Al_2O_3 + Mn$ | 37,000 | (3) |
| $FeO + \frac{2}{3}Al \longrightarrow \frac{1}{3}Al_2O_3 + Fe$ | 65,000 | (4) |
| In the case of Si reduction | | |
| $Cr_2O_3 + \frac{3}{2}Si \longrightarrow \frac{3}{2}SiO_2 + 2Cr$ | 42,200 | (5) |
| $MnO + \frac{1}{2}Si \longrightarrow \frac{1}{2}SiO_2 + Mn$ | 9,800 | (6) |
| $FeO + \frac{1}{2}Si \longrightarrow \frac{1}{2}SiO_2 + Fe$ | 38,000 | (7) |

The Al reduction differs most widely from the Si reduction in the respect that its reducing power is so high as to cause reduction of even the $SiO_2$ present in the slag. They are also different vastly from each other in terms of the amount of heat generated during the reduction reaction.

Comparison of Formula (1) and Formula (5) clearly shows that when 1 mol of chromium oxide is reduced, the amount of heat generated in the Al reduction is three times as much as in the Si reduction. Further, because 80% of the oxides in the slag are accounted for by $Cr_2O_3$ and $SiO_2$, the difference in the amount of heat generated as a whole is fairly large. It is generally estimated to be 4 to 5 times as large. This heavy generation of heat during the reduction brings about an unusually large effect upon reduction and desulfurization. When the reduction of oxides with Al results in generating a large amount of heat, CaO existing in the immediate neighborhood is abruptly converted into a $CaO—Al_2O_3$ type slag. This slag possesses a considerably lower melting point than the temperature of the molten steel as already described, and exhibits fluidity befitting desulfurization. Thus, even in the absence of a slag-forming agent such as $CaF_2$, the reduction proceeds quickly and the desulfurization is effected with high efficiency.

As the result, it becomes possible to effect the reduction and the desulfurization at the same time as illustrated in FIG. 1(*b*) instead of discarding the slag and performing the step of desulfurization separately as illustrated in FIG. 1(*a*). Thus, there are brought about notable effects in reducing consumption of slag-forming agents such as CaO and $CaF_2$ and gases, improving productivity through decrease of operation time, and reducing consumption of refractories of the AOD furnace.

Further, as illustrated in FIG. 1(*c*), the oxides produced in the molten steel bath and the oxides passed into the slag (both mainly in the form of $Cr_2O_3$) already during the course of the decarburization, are utilized for decarburizing the molten steel through agitation by argon gas blowing in the terminal phase of the decarburization. In the meantime, the slag maintains its fluidity by allowing such oxides to be retained in the minimum amount necessary for decarburization. The fact that Al and CaO are added in advance to the slag for the purpose of promoting passage of $Cr_2O_3$ from the slag to the molten steel makes it possible to shorten further the time required for the reduction and the desulfurization after completion of the decarburization. This addition is additionally effective in reducing the cost of refractories of the AOD furnace and the cost of gases.

By following the procedure shown in FIG. 1(*c*), the reducing agent and the slag-forming agent are further added after completion of the decarburization, then the agitation of the molten steel by argon gas blowing is continued for three minutes, and the steel is tapped. The reactions of reduction and desulfurization are further accelerated by the effect of the agitation continued during the tapping of the steel. Thus, the conditions, $(S)/[S]>50$ and [S] in steel $<30$ ppm, are stabilized.

The effects obtained when the procedures illustrated in FIGS. 1(*a*), (*b*), and (*c*) are followed are compared in Table 1, using 100 as a reference value for the conventional process.

TABLE 1

| | Consumption | | | | Time for reduction and desulfurization | Desulfurizing ability ΔSkg/CaO—t |
|---|---|---|---|---|---|---|
| | CaO | $CaF_2$ | Refractories for AOD furnace | Argon gas | | |
| Conventional process, FIG. 1(a) | 100 | 100 | 100 | 100 | 100 | 100 |
| Process of this invention, FIG. 1(b) | 65 | 0 | 75 | 50 | 50 | 120 |
| Process of this invention, FIG. 1(c) | 65 | 0 | 70 | 30 | 30 | 110 |

Further, this invention is quite effective in the production of Ti-containing steel. Heretofore, in the production of Ti-containing steel by the AOD process, the slag remaining after completion of the reduction is discharged as much as possible to minimize the residual slag and, thereafter, Al is added to effect reduction of $SiO_2$ present in the slag so as to reduce the amount of Ti consumed in the reduction of $SiO_2$, and Ti is added immediately before tapping of steel as shown in FIG. 1(*d*).

In accordance with this invention, since $SiO_2$ in the slag is already reduced with Al, the slag is not required to be discarded as shown in FIG. 1(*e*) and Ti may be added immediately before tapping of steel. Even if the slag is discarded, there is no need to pay meticulous care to the maximum removal of the slag as required by the conventional process. In this case, the removal of the slag obtained by tilting the furnace and allowing the slag to flow out as shown in FIG. 1(*f*) may suffice. Then, without turning the furnace back to the refining position, the steel is tapped from the tilted furnace into the ladle to which Ti is added in advance.

In all the procedures, the process of this invention notably saves time and labor, improves the operational efficiency, and reduces the unit ratio of gases and the unit ratio of bricks in the furnace as compared with the conventional process. Further, the process does not require the furnace to be turned back to the refining position after the removal of the slag and suffers the absorption of [N] to a notably low extent as compared with the conventional process and, therefore, proves highly advantageous for the production of Ti-containing steel which avoids as much as possible the absorption of [N].

In this case, the application of the procedure which comprises effecting decarburization by the agitation with argon gas in the final phase of the decarburization and adding Al and CaO in the meantime as shown in FIG. 1(*c*), to the procedures of FIGS. 1(*e*) and (*f*), further enhances the effects of the present invention.

The effects of the present invention manifested in the production of Ti-containing stainless steel (SUS 321) are summarized in Table 2. From this table, it is noted that the procedure of FIG. 1(*f*) excels in terms of the yield of Ti, and that of FIG. 1(*e*) excels in terms of the reduction of time, the consumption of refractories of the furnace, and the prevention of [N] absorption.

TABLE 2

| | Consumption | | | | Time for reduction and desulfurization | Yield of Ti | Absorption of [N] | Desulfurizing ability (ΔSkg/CaO—t) |
|---|---|---|---|---|---|---|---|---|
| | CaO | $CaF_2$ | Refractories of AOD furnace | Argon gas | | | | |
| Conventional process, FIG. 1(d) | 100 | 100 | 100 | 100 | 100 | 100 | 100 | 100 |
| Process of | 65 | 0 | 75 | 50 | 50 | 80 | 80 | 120 |

TABLE 2-continued

| | Consumption | | | | Time for reduction and desulfurization | Yield of Ti | Absorption of [N] | Desulfurizing ability (ΔSkg/CaO—t) |
|---|---|---|---|---|---|---|---|---|
| | CaO | $CaF_2$ | Refractories of AOD furnace | Argon gas | | | | |
| this invention, FIG. 1(e) | | | | | | to 100 | | |
| Process of this invention, FIG. 1(f) | 65 | 0 | 80 | 50 | 70 | 100 | 90 | 120 |

Typical slag compositions formed in accordance with the process of this invention are shown in Table 3. A typical composition of commercially available alumina cement is also shown.

TABLE 3

| | CaO | $SiO_2$ | $Al_2O_3$ | MgO | $Cr_2O_3$ | $Fe_2O_3$ |
|---|---|---|---|---|---|---|
| Slag 1 of this invention | % 45.0 | 5.0 | 41.0 | 8.5 | 0.5 | — |
| Slag 2 of this invention | 45.5 | 4.0 | 44.5 | 4.5 | 1.5 | — |
| Slag 3 of this invention | 42.5 | 6.5 | 40.0 | 11.0 | 0.5 | — |
| Alumina cement | 35 to 44 | 3 to 11 | 35 to 44 | — | — | 4 to 12 |

It is noted from the table that the slag compositions are quite similar to one another and, through slight adjustment of components, they can be reclaimed as alumina cement. Thus, this invention may well be called an epochal step toward development of a new field for the utilization of the slag.

As described in detail above, this invention manifests a striking effect in the reduction and desulfurization of chromium-containing steel and, at the same time, the slag produced consequently promises a new utility. Thus, this method proves highly advantageous to the industry.

Further in accordance with the process of this invention, the S content in steel can be stably lowered to less than 10 ppm by controlling the $CaO/Al_2O_3$ ratio in the slag within the range of 1.4 to 2.0.

Generally, the reaction of desulfurization of chromium-containing molten steel is a reaction between the slag and the metal as represented by Formula (8).

$$[S] + (O^{2-}) \longrightarrow [O] + (S^{2-}),\ K_s = \frac{a_s^{2-} a_o}{a_s \cdot a_o^{2-}} \tag{8}$$

Therefore, $$\log \frac{(\%\ S)}{[\%\ S]} \cdot a_o = \log a_o^{2-} + \log K_s' \tag{9}$$

wherein [S] stands for S in the steel, $(S^{2-})$ for S in the slag, [O] for O in the steel, $(O^{2-})$ for basic oxide in the slag, $K_s$ or equilibrium constant of the desulfurization, reaction $K_s'$ for apparent equilibrium constant of the desulfurization, reaction $a_s$ activity of S in the steel, $a_s^{2-}$ for activity of S in the slag, $a_o$ for activity of O in the steel, $a_o^{2-}$ for activity of basic oxide in the slag, [%S] for S concentration in the steel, and (%S) for S concentration in the slag.

The lefthand member of Formula (9) is termed as sulfide capacity.

In the refining of chromium-containing molten steel, the sulfide capacity reaches its maximum when the $(\%CaO)/(\%Al_2O_3)$ ratio falls in the range of 1.4 to 2.0 under the condition that the $(\%SiO_2)$ in the slag after the decarburization and reduction is not more than 10%.

Figure 3:
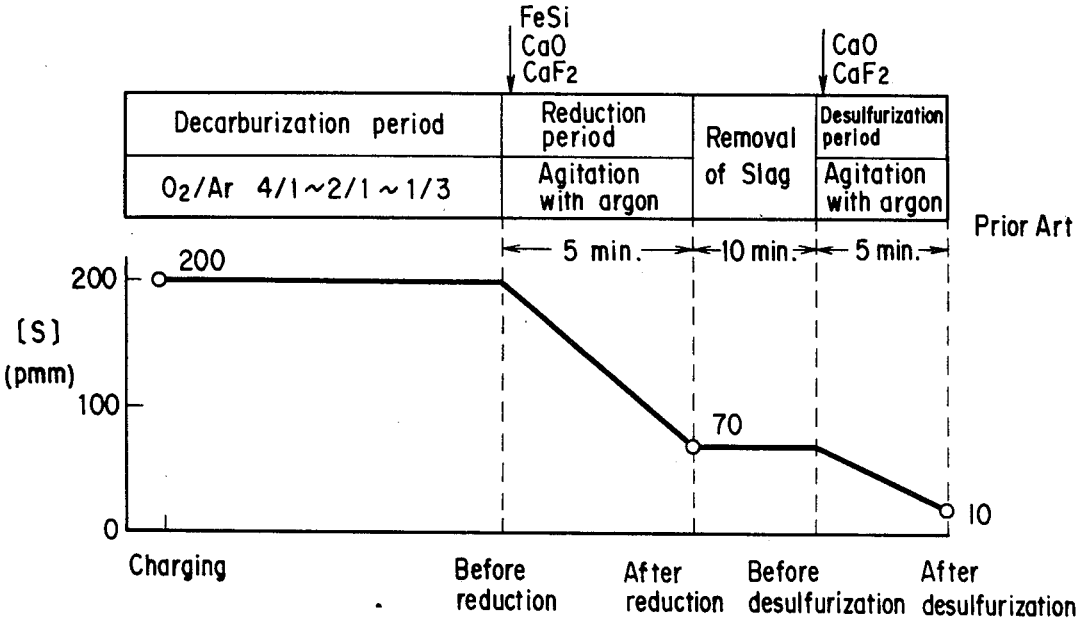
FIG. 3(*a*) is a diagram showing the change of S in the chromium-containing molten steel through the steps of decarburization, reduction, and desulfurization performed on the molten steel by the conventional AOD process.
Figure 3:
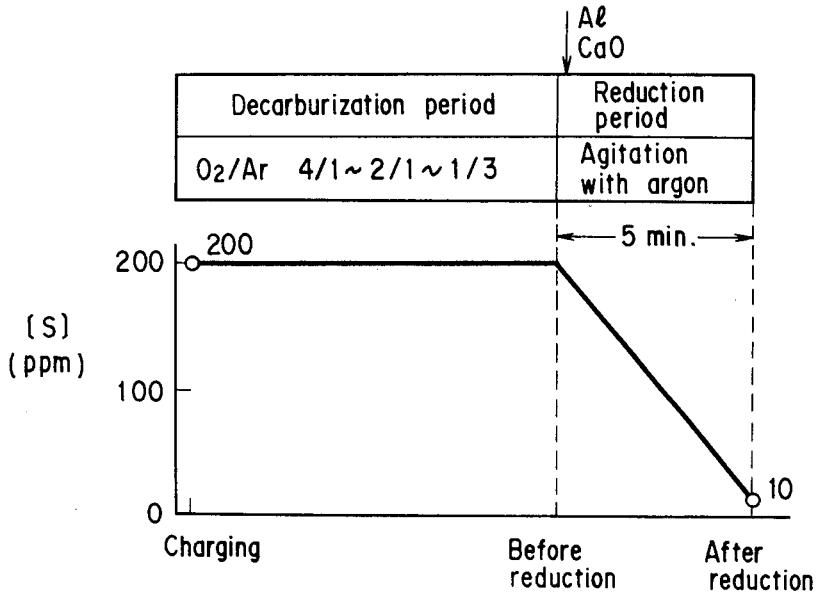
Figure 3:
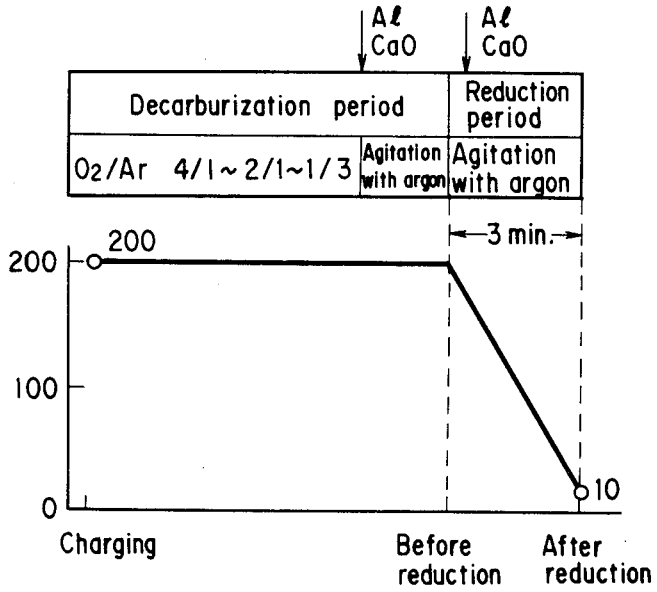

Now, working examples of this invention as applied to the AOD process under the condition that the $CaO/Al_2O_3$ ratio in the slag is controlled in the range of 1.4 to 2.0, FIG. 3(*a*) illustrates the steps of decarburization, reduction, and desulfurization of chromium-containing molten steel performed by the conventional process adopting the AOD process. In the established technique, the slag's basicity $(\%CaO)/(\%SiO_2)$ after completion of the decarburization is controlled in the range of 1.4 to 1.8 by adding Fe—Si for reduction and CaO and $CaF_2$ as slag-forming agents, and the molten steel bath is agitated by argon gas blowing to commence the reduction of chromium oxide. During the course of this reduction, desulfurization is also carried out. In this case, since the melting point of the slag is high as already described, the formation of slag and the retention of fluidity of the slag are not fully effected. It is, therefore, customary for the desulfurization to be carried out after the existent slag has been discarded and replaced with newly prepared slag to warrant high basicity of the slag.

Figure 4:
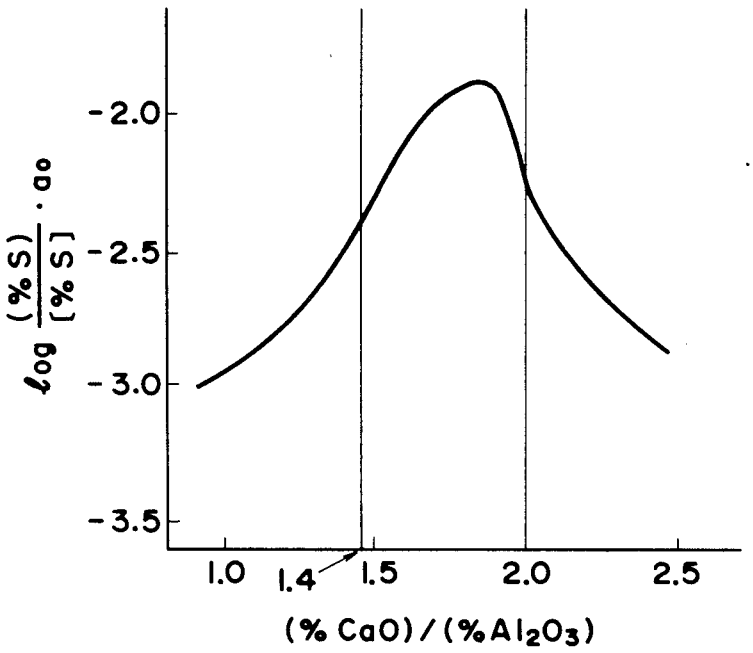
FIG. 4 is a graph showing the relation between the $(\%CaO)/(\%Al_2O_3)$ ratio and the sulfide capacity in the slag under the condition of $(\%SiO_2) \leqq 10\%$ after the steps of decarburization and reduction in the refining of chromium-containing molten steel.

FIG. 3(*b*) represents a working example satisfying the condition that the $CaO/Al_2O_3$ ratio falls in the range of 1.4 to 2.0. When the slag composition is adjusted to satisfy this condition, the desulfurization ability is maximized as shown in FIG. 4, the necessity for including a separate step of desulfurization after discharge of the slag shown in FIG. 3(*a*) is obviated, the decrease of the [S] content in the steel below 10 ppm can be easily attained, the decrease of consumption of slag-forming agents such as CaO and $CaF_2$ and consumption of gases is materialized, the improvement of productivity due to reduction of the time required for the process is ensured, and the reduction of consumption of refractories for the AOD furnace is achieved.

FIG. 3(*c*) represents another working example of the present invention. In this case, the decarburization of the molten steel bath by agitation with argon gas blowing is effected advantageously in the terminal phase of the step of decarburization by the use of the oxides generated in the molten steel bath and the oxides passed into the slag (both mainly in the form of $Cr_2O_3$) already during the course of the decarburization. In the meantime, the slag is allowed to retain its fluidity by causing the oxides to retain in the slag in the minimum amount necessary for decarburization. Al and CaO are added in advance for the purpose of accelerating the passage of $Cr_2O_3$ from the slag to the steel. The procedure described above makes it possible to reduce further the time required for the treatments of reduction and desulfurization after completion of the decarburization. It is further effective in reducing the cost of refractories in the AOD furnace and the cost of gases.

By following the procedure of FIG. 3(*c*), i.e. by adding further reducing agent and further slag-forming agent after completion of the decarburization, effecting the agitation of the molten steel bath by argon gas blowing for three minutes, tapping the steel, and allowing the reduction and desulfurization reactions to proceed smoothly by the effect of the agitation performed during the tap of the steel, the conditions, (%S) in slag/[%S] in steel > 200, and [S] in steel < 10 ppm, can be stabilized.

Example:

This invention was embodied in the refining by the AOD process under the conditions: kind of steel SUS 304, amount of slag and steel 60 T, and flow volume of argon gas during agitation with argon 40 $Nm^3$/minute. The results are shown in FIGS. 3(*b*), (*c*). In this case, the duration of argon agitation during the step of reduction in the procedure of FIG. 3(*b*) was 5 minutes and that in the procedure of FIG. 3(*c*) was 3 minutes.

Table 4 shows the effects obtained by adopting the procedures of FIGS. 3(*a*), (*b*), and (*c*). In the refinement by the AOD process for the production of steel having an extremely low sulfur content below 10 ppm, the process of this invention notably shortened the time for the refining as compared with the conventional process. Consequently, the consumption of argon gas, refractories of the AOD furnace, and CaO and $CaF_2$ were notably lowered.

Effect:

By the process of this invention, the reduction and the desulfurization of chromium-containing molten steel can be carried out simultaneously to produce steel of very low sulfur content. Consequently, the process is highly effective in improving the service life of the furnace and economizing energy. Further, the slag produced in the refining by the process of this invention can be utilized effectively as the raw material for cement. Thus, this invention gives a perfect solution to the problems of the disposal of the slag.

TABLE 4

| | Desulfurizing ability S/CaO (kg/T) | [S] level (ppm) attained after 3 minutes' agitation | Consumptions necessary for attainment of [S] ≦ 10 ppm | | | | |
|---|---|---|---|---|---|---|---|
| | | | Time | Argon gas | Refractories for AOD furnace | CaO | $CaF_2$ |
| Conventional process, FIG. 3(a) | 100 | ≦70 | 100 | 100 | 100 | 100 | 100 |
| Process of this invention, FIG. 3(b) | 150 | ≦20 | 25 | 50 | 60 | 75 | 0 |
| Process of this invention, FIG. 3(c) | 150 | ≦10 | 15 | 30 | 40 | 75 | 0 |

What is claimed is:

1. A process for refining chromium-containing molten steel by decarburization reduction and desulfurization, which comprises adding to slag existing after completion of said decarburization, metallic Al as a reducing agent and CaO as a slag-forming agent respectively in amounts necessary for said slag, after completion of the subsequent reduction, to acquire a $SiO_2$ content of not more than 10% and a $CaO/Al_2O_3$ ratio in the range of 0.8 to 2.0, thereby enabling said reduction and desulfurization to proceed simultaneously.

2. A process according to claim 1, wherein said $CaO/Al_2O_3$ ratio in said slag falls in the range of 1.4 to 2.0.

3. A process according to claim 1, wherein agitation of the molten steel and the slag by argon gas blowing, and partial addition of metallic Al and CaO, are effected during the terminal phase of said decarburization.

4. A process according to claim 1, wherein after said addition of metallic Al and CaO subsequent to completion of said decarburization, agitation of the molten steel and the slag for 3 minutes by argon gas blowing are effected, and the steel is then tapped.

5. A process according to claim 1, wherein desulfurization is conducted until the concentration of S in the steel is less than 30 ppm.

6. A process according to claim 1, wherein desulfurization is conducted until the concentration of S in the steel is less than 10 ppm.

* * * * *